US005617746A

United States Patent [19]

Hong et al.

[11] Patent Number: 5,617,746

[45] Date of Patent: Apr. 8, 1997

[54] PRESSURE DEHYDRATION LOW-FREQUENCY VIBRATION WASHING MACHINE

[75] Inventors: Kyung S. Hong, Incheon-si; Dong Y. Oh, Kyungki-do; Gyu S. Choi, Kyungki-do; Joo H. Lee, Kyungki-do; Oh H. Kwon, Seoul; Ha I. Lee, Kyungki-do; Kyeong H. Kim, Seoul, all of Rep. of Korea

[73] Assignee: LG Electronics Inc., Seoul, Rep. of Korea

[21] Appl. No.: 547,611

[22] Filed: Oct. 24, 1995

[30] Foreign Application Priority Data

Oct. 24, 1994 [KR] Rep. of Korea ..... 27176/1994
Jul. 31, 1995 [KR] Rep. of Korea ..... 23482/1995

[51] Int. Cl.[6] ..... D06F 17/00; D06F 19/00

[52] U.S. Cl. ..... 68/21; 68/133; 68/183

[58] Field of Search ..... 68/21, 133, 96, 68/113, 183

[56] References Cited

U.S. PATENT DOCUMENTS 2,593,292 4/1952 Gaugler ..... 68/21
2,641,916 6/1953 Johnson ..... 68/21
2,647,385 8/1953 Candor ..... 68/21
2,653,465 9/1953 Baade ..... 68/21
2,766,601 10/1956 Thiele ..... 68/21
2,770,961 11/1956 Stevenson et al. ..... 68/21
2,824,438 2/1958 Candor ..... 68/21
5,176,012 1/1993 Oh et al. ..... 68/21

*Primary Examiner*—Philip R. Coe
*Attorney, Agent, or Firm*—Fish & Richardson PC

[57] ABSTRACT

A pressure dehydration low-frequency washing machine with a simplified structure using a single motor and a driving mechanism, including an electromotive rotation shaft horizontally installed below a washing tub, a selective drive for driving an oscillating plate of the washing tub by selectively converting rotation force of the electromotive rotation shaft to a reciprocation force according to the rotation direction of the electromotive rotation shaft, an air-compressor for converting the rotation force of the electromotive rotation shaft to a reciprocation force and compressing air by means of a piston driven by the reciprocation force, a pressure-applying dehydrator for applying pressure and dehydrating the laundry in the washing tub by being expanded by compressed air from the air-compressor when the electromotive rotation shaft is rotated in a direction where the selective drive is not driven, and a controller for selectively transferring the compressed air in the air-compressor to the pressure-applying dehydrator.

7 Claims, 9 Drawing Sheets

FIG.3

| | V1 | V2 | V3 | V4 | V5 | V6 |
|---|---|---|---|---|---|---|
| WATER SUPPLYING MODE | O | O | X | X | X | X |
| WASHING MODE | X | X | X | O | X | X |
| AIR INJECTING MODE | X | O | X | X | O | X |
| PRESSURE APPLYING MODE | X | X | O | X | X | O |
| PRESSURE REDUCING MODE | X | X | O | O | X | O |
| COMPLETION MODE | X | O | X | O | O | X |

FIG.10

| | OPEN | CLOSE | |
|---|---|---|---|
| WATER SUPPLYING | 14,15 | 21, 22, 16 19, 20 | |
| WASHING | 21,22 | 16, 14, 15 19, 20 | P1,P3 |
| DEHYDRATION STEP 1 | 16,20 | 21, 22, 14 19, 19 | P1,P3 |
| DEHYDRATION STEP 2 | 16,20 | 21, 22, 14 15, 19 | P1,P4 |
| COMPLETION | 16,14,20 | 21, 22, 15 19 | P2,P3 |
| AIR INJECTING IN WASHING | 22,19 | 21, 16, 14 15, 20 | P1,P3 |

PRESSURE DEHYDRATION LOW-FREQUENCY VIBRATION WASHING MACHINE

BACKGROUND OF THE INVENTION

The present invention relates to a pressure dehydration low-frequency washing machine, and more particularly to a pressure dehydration low-frequency washing machine which drives a compressing means and a vibrator driving means with a single motor.

A conventional full automatic washing machine is as shown in FIG. 1. A washing tub 1*a* is rotatably installed inside of an outer tub 29, and a pulsator 30 is installed inside of washing machine 1*a*. A clutch 31 is installed beneath the base of outer tub 29, and a dehydration shaft 32 and a washing shaft 33 are separately associated with the clutch by penetrating through washing tub 1*a* and pulsator 30. A motor pulley 35 and a clutch pulley 36 are installed at a motor 34 arranged at a portion of the outer tub base and clutch 31, respectively. A V-belt 37 is wound on between motor pulley and clutch pulley 36 to transfer power.

Thus, in washing, washing tub 1*a* is generally being stopped, and the laundry is washed by alternative agitation of pulsator 30. In dehydration, washing tub 1*a* and pulsator 30 rotate at the same high speed to dehydrate.

Such a dehydration mechanism is being applied to a currently developed low frequency vibration washing machine. Namely, both reciprocation structure for washing and rotation structure for centrifugal dehydration are installed in the low frequency washing machine. However, such a low frequency washing machine has the following problems.

First, the structure of a washing machine becomes totally sophisticated due to the structures used for reciprocation and rotation.

Second, since the double structure of an outer tub 29 and a washing tub 1*a* is provided in a centrifugal dehydration type washer, there is an undesirable consumption of water between outer tub 29 and washing tub 1*a*.

Third, to maintain balance is difficult due to vibration caused by rotation of washing tub 1*a* in dehydration.

Fourth, textiles get severely tangled and damaged due to rotation of the washing tub during dehydration.

SUMMARY OF THE INVENTION

To solve the above problems, it is an object of the present invention to provide a pressure dehydration low-frequency washing machine where the structure is simplified by using a single motor and a driving mechanism therefor.

Accordingly, to achieve the above object, there is provided a driving mechanism of a pressure dehydration low-frequency washing machine comprising: an electromotive rotative shaft horizontally installed at the lower of a washing tub; selective driving means for driving an oscillator of the washing tub by selectively converting rotation force of the electromotive rotation shaft to reciprocation force according to the rotation direction of the electromotive rotation shaft; air-compressing means for converting the rotation force of the electromotive rotation shaft to reciprocation force and compressing air by means of a piston driven by the reciprocation force; pressure-applying dehydration means for applying pressure and dehydrating the laundry in the washing tub by being expanded by compressed air in the air-compressing means when the electromotive rotation shaft is rotated in a direction where the selective driving means is not driven; and controlling means for selectively transferring the compressed air in the air-compressing means to the pressure-applying dehydration means.

To achieve the above object, there is provided a driving mechanism of a pressure dehydration low-frequency washing machine comprising: a reciprocation shaft, being vertically installed under a washing tub, for reciprocating a vibrator to vibrate and wash the laundry; driving/compressing means, being made coaxial to the reciprocation shaft, for driving an electromotive reciprocation shaft up and down, compressing air with up and down strokes of the reciprocation shaft, and injecting the compressed air into the washing tub; pressure-applying dehydration means for applying pressure and dehydrating the laundry in the washing tub by expansion of the air compressed by means of the driving/dehydrating means; and intaking dehydration means for passing through a venturi tube the compressed air and intaking water from the laundry by utilizing sharp fall of pressure produced in the venturi tube.

BRIEF DESCRIPTION OF THE DRAWINGS

The above objects and advantages of the present invention will become more apparent by describing in detail a preferred embodiment thereof with reference to the attached drawings in which:

FIG. 3 is a view showing a valve control table of the driving mechanism of a pressure dehydration low-frequency vibration washing machine according to the present invention;

FIG. 10 is a table containing opening/closing states and positions of each valve shown in FIG. 9.

DETAILED DESCRIPTION OF THE INVENTION

An preferred embodiment of the present invention will be described now referring to FIGS. 2 through 8.

Figure 2:
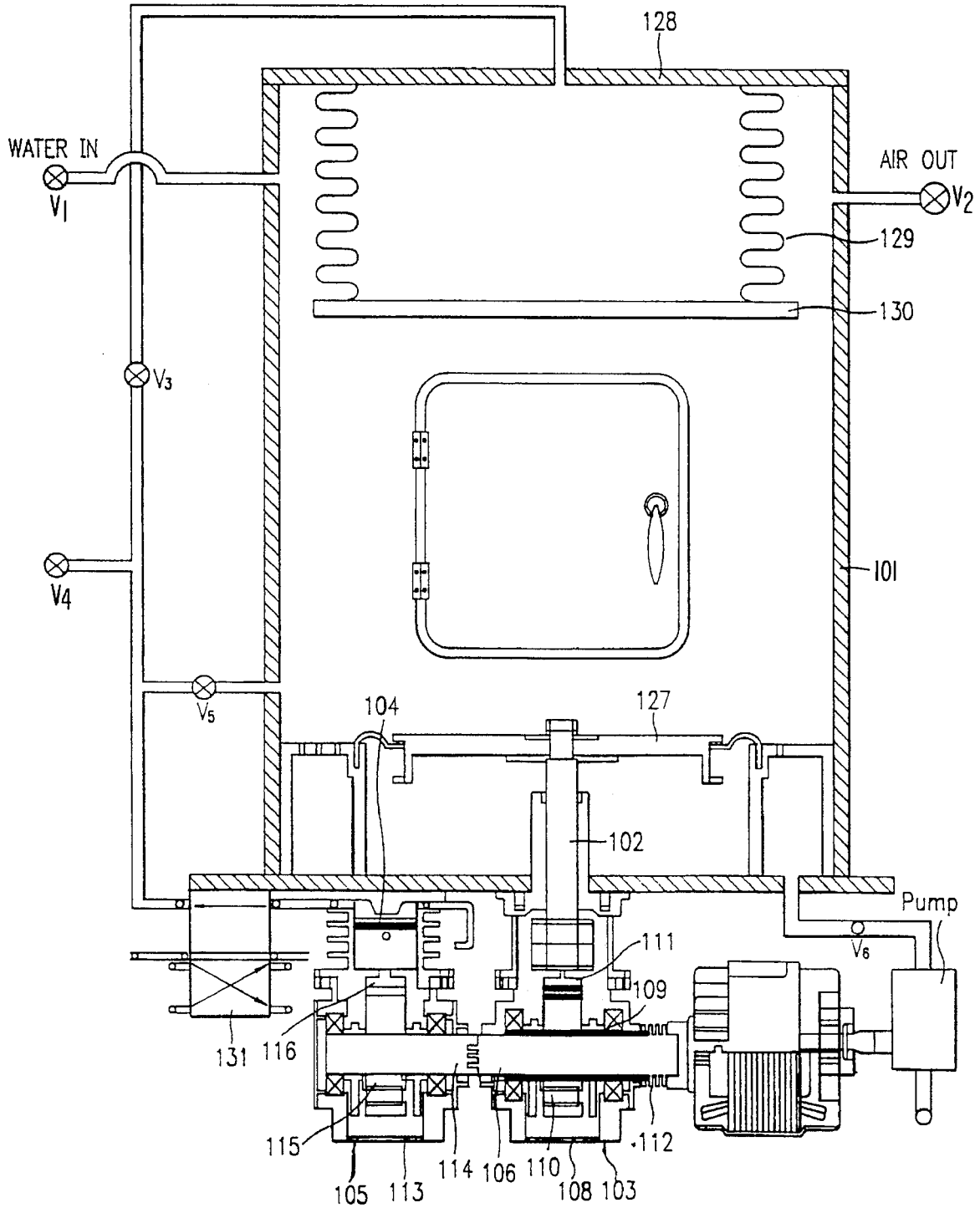
FIG. 2 is a section illustrating a structure of a driving mechanism of a pressure dehydration low-frequency vibration washing machine according to the present invention.
Figure 4:
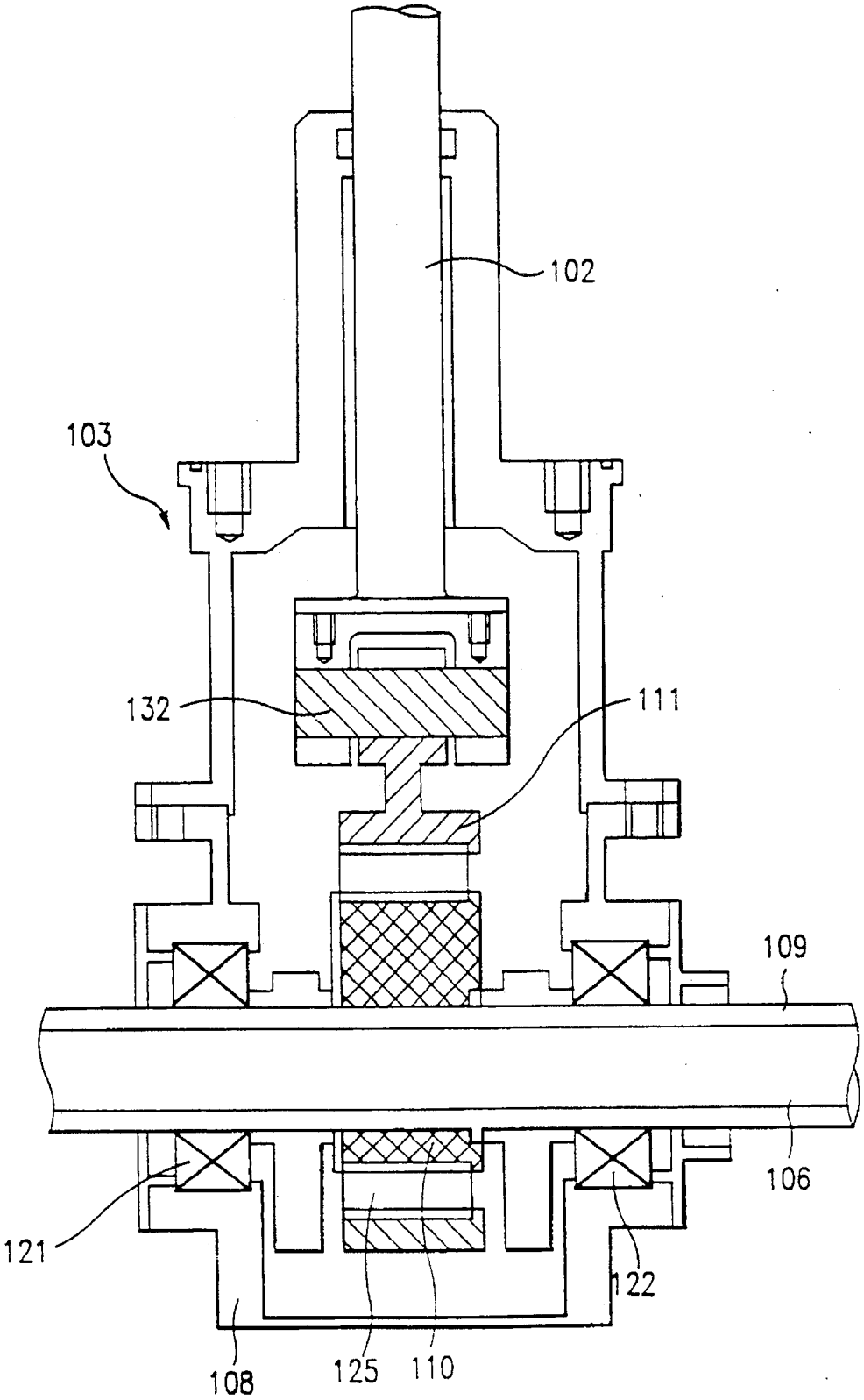
FIGS. 4 through 5 are vertical sections illustrating a washing driver constituting the driving mechanism of the present invention.
Figure 5:
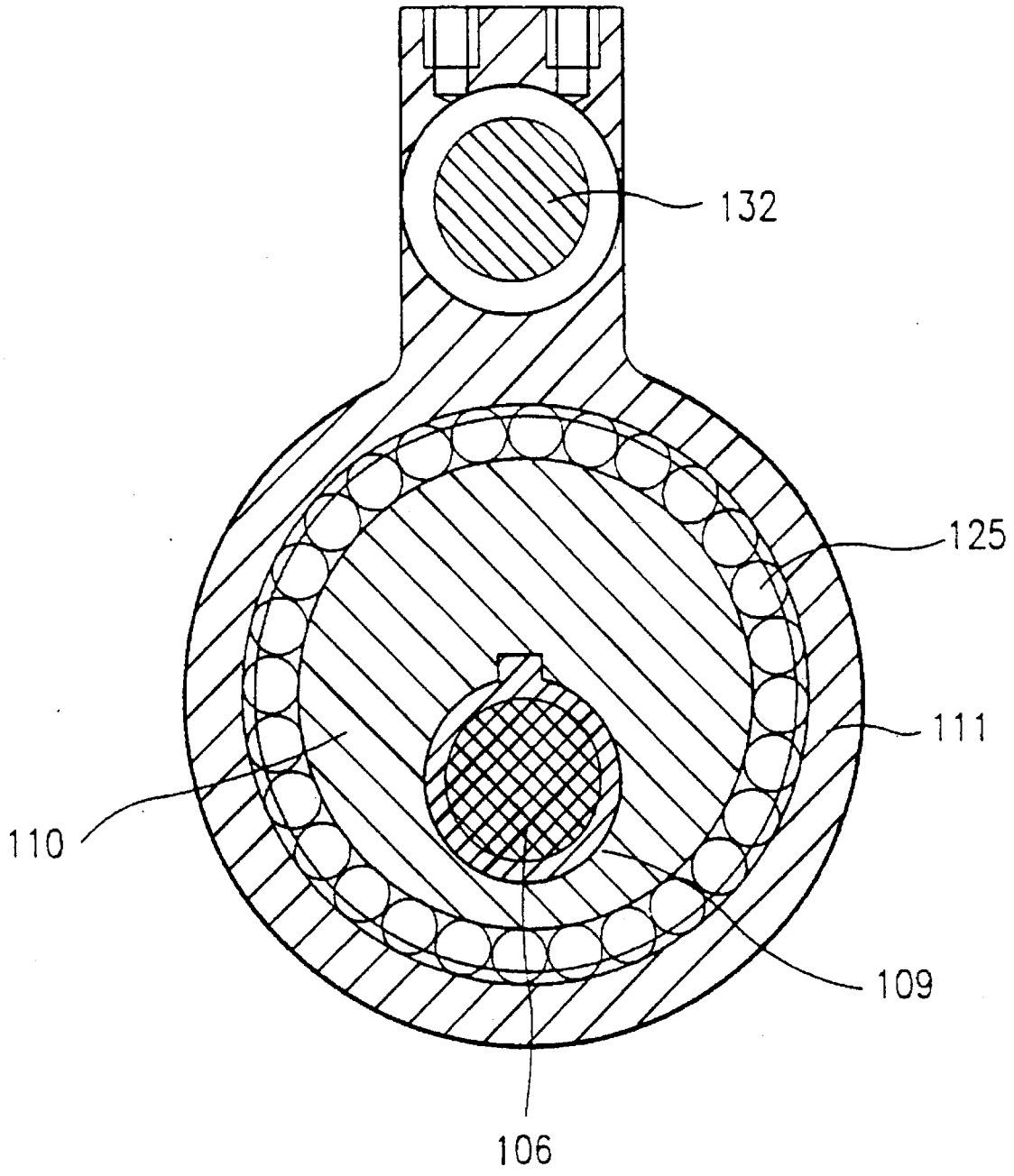
Figure 6:
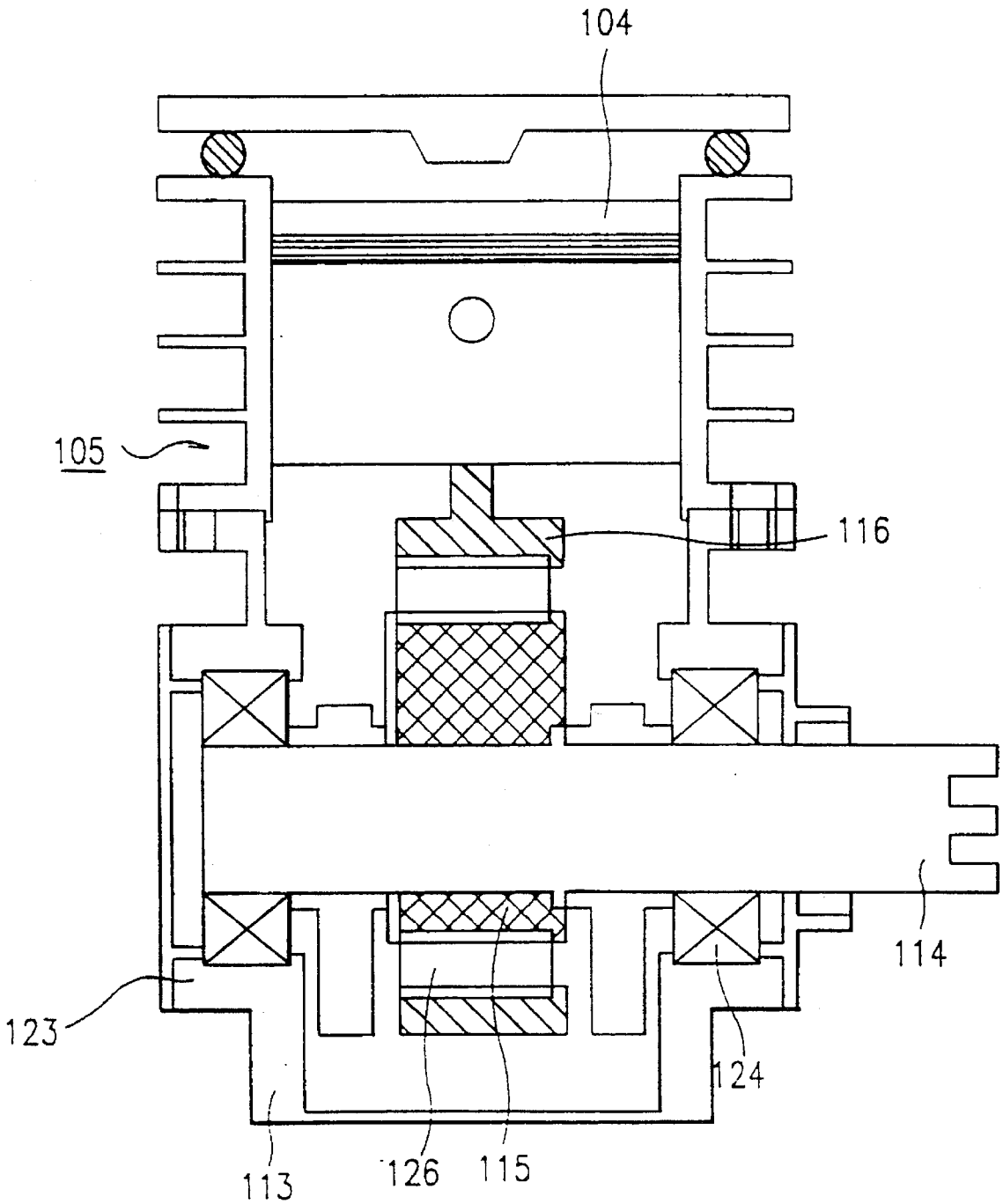
FIGS. 6 through 7 are vertical sections illustrating an air-compressor constituting the driving mechanism of the present invention.
Figure 7:
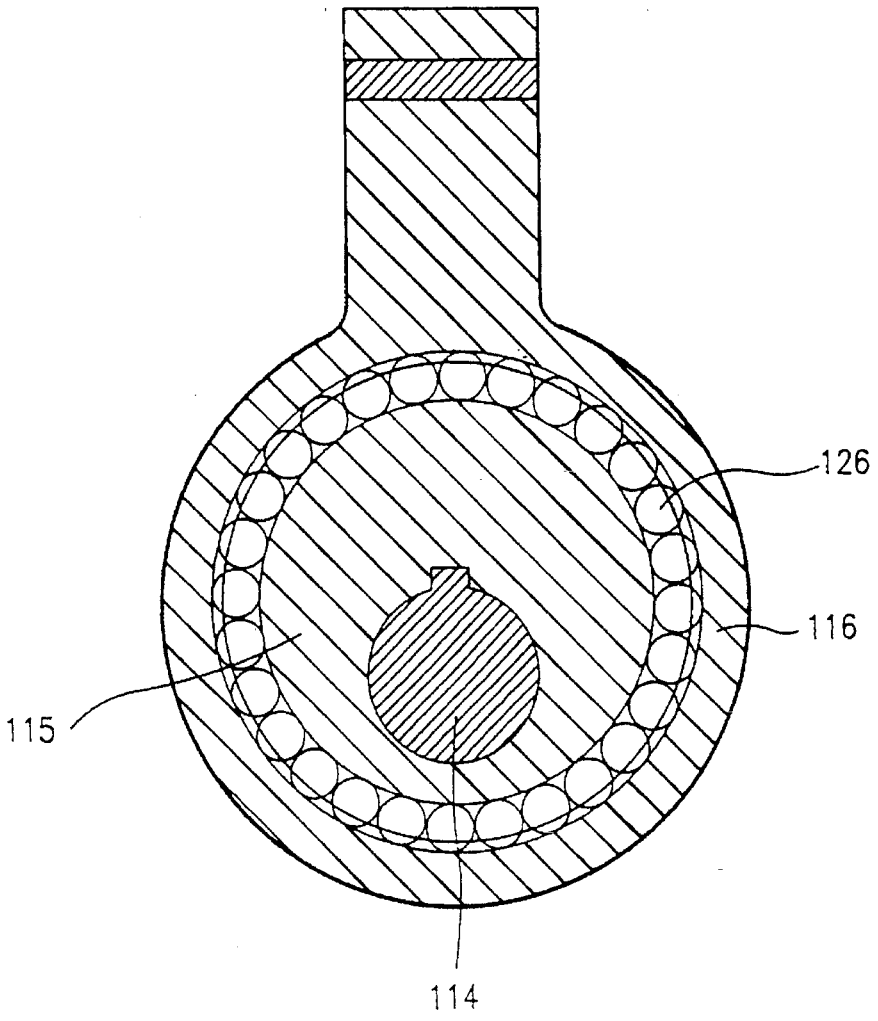
Figure 8:
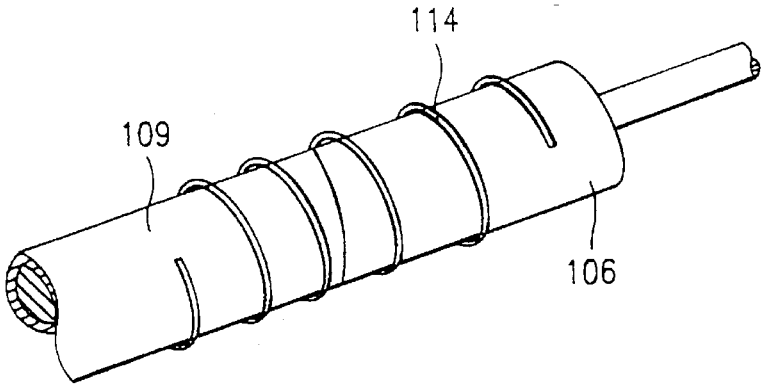
FIG. 8 is a perspective view showing a connecting state of an induced motor and the washing driver of the driving mechanism of the present invention.

As shown in FIGS. 2 and 3, the embodiment of the present invention comprises an electromotive rotative shaft 106 horizontally installed at the lower end of a washing tub 101, a selective driving means for driving an oscillator 127 of washing tub 101 by selectively converting rotation force of electromotive rotation shaft 106 to reciprocation force according to the rotation direction of electromotive rotation shaft 106, an air-compressing means for converting the rotation force of electromotive rotation shaft 106 to reciprocation force and compressing air by means of a piston 104 driven by the reciprocation force, a pressure-applying dehydration means for applying pressure and dehydrating the laundry in washing tub 101 by being expanded by compressed air in the air-compressing means when electromotive rotation shaft 106 is rotated in a direction where the selective driving means is not driven, and a controlling means for selectively transferring the compressed air in the air-compressing means to the pressure-applying dehydration means. Electromotive rotation shaft 106 is driven by induction motor 107.

The selective driving means is coupled with a case 108 of the selective driving means in the state of being horizontally rotatable, and comprises a hollow shaft 109 where electromotive rotation shaft 106 is inserted therein, a cam 110 fixed to the circumference of hollow shaft 109, a connecting rod 111, being rotatively coupled at the circumference of cam 111, for transferring the reciprocation, a reciprocation shaft 102 for transferring the reciprocation transferred from connecting rod 111 to vibrator 127, and a clutch means for selectively coupling electromotive rotation shaft 106 and hollow shaft 109.

The clutch means is a clutch spring 112 for selectively transferring the power of the rotation shaft to hollow shaft 109 according to the rotation direction of rotation shaft 106, being coupled at a linking area of electromotive rotation shaft 106 and hollow shaft 109.

The operation of the controlling means comprises the steps of injecting air to the laundry being washed in a washing mode, implanting air to the compressing means when a dehydration mode begins after the washing mode ends, and extracting air in the compressing means when the dehydration mode completes.

The air-compressing means is coupled with case 113 thereof to be rotatively in a horizontal direction, and comprises a linking shaft 114 at the one end of which electromotive rotation shaft 106 of motor 107 is united and fixed, a cam 115 united and fixed to linking shaft 114, and a connecting rod 116 rotatably united with cam 115 and connected to piston 104.

Hollow shaft 109 and linking shaft 114 are supported at cases 108 and 113 by bearings 121, 122, 123 and 124. Needle roller bearings 125 and 128 are interposed between cams 110 and 115 and connecting rods 111 and 116.

Vibrator 127 is fixed at the upper end of reciprocation shaft 102, and a bellows 129 is installed at the lower side of a cover 128 above washing tub 101. A pressing plate 130 is installed beneath bellows 129. Bellows 129 and pressing plate 130 are main components of the pressure-applying dehydration means.

Reference numerals 131 and 132 denote a direction converting valve and a linking pin, respectively, and V1, V2, V3, V4, V5 and V6 indicate each valve.

An operating mode of a pressure dehydration low-frequency vibration washing machine having such a structure can be divided into a washing mode and a dehydration mode. Concretely, there are a water supplying mode, a washing and air implanting mode, a pressure applying mode, a pressure reducing mode, and a completion mode.

1. Water Supplying Mode

When input of laundry into the tub 101 is completed, washing tub 101 is closed. At this time, the driving of motor 107 is stopped and V1 is open to supply water. To extract as much air as the amount of water supplied V2 is also open. V3 through V6 are closed.

2. Washing and Air Implanting Mode

Motor 107 rotates in the winding direction of clutch spring 112, and the direction converting valve is positioned at a "washing/comp" mode. In washing, when motor 107 driven in a direction of rotating cam 110 by clutch spring 112, electromotive rotation shaft 106 and hollow shaft 109 of motor 107 engage and rotate. Cam 110 begins to rotates by the rotation of hollow shaft 109, and thus, connecting rod 11 associated with cam 110 begins to move up and down. Vibrator 127 moves up and down according to the rising and falling of reciprocation shaft 102 connected to connecting rod 111 by pin 132. Consequently, the washing mode is performed by the vibration of vibrator 127.

Linking shaft 114 of air-compressing means 105 coupled with rotation shaft 106 of motor 107 continuously rotates by the rotation of rotation shaft 106. When linking shaft 114 rotates and piston 104 moves down, air flows in from outside. On the contrary, when piston 104 moves up, the input air is pumped through a pipe.

For improving washing effect by implanting air into washing tub 101 in washing, air compressing means 105 directly connected to motor 107 always operates during washing. When there is no need to inject air, V5 is close to make air from the air-compressing means 105 flow outside.

On the contrary, when there is need to implant air, V5 is open so that compressed air flows into washing tub 101.

Here, when V2 is opened additionally, the inner pressure of washing tub 101 is maintained constant, however, when the V2 is closed, the inner pressure rises since no air is extracted.

3. Pressure Applying Mode

To generate air pressure needed for pressure dehydration, the compressed air generated in air-compressing means 105 should be input to the inside of washing tub 101. However, if vibrator 127 operates together during pressure dehydration, a heavy load is applied to cam 110. That is, in the dehydration mode, only air-compressing means 105 operates and vibrator 127 should not be operated. To satisfy this condition, rotation shaft 106 of motor 107 rotates in a releasing direction of clutch spring 112. Accordingly, the power of rotation shaft 106 is transferred not to hollow shaft 109 but to linking shaft 114 of air-compressing means 105. Consequently, the required air pressure is generated by means of reciprocation of piston 104.

Figure 1:
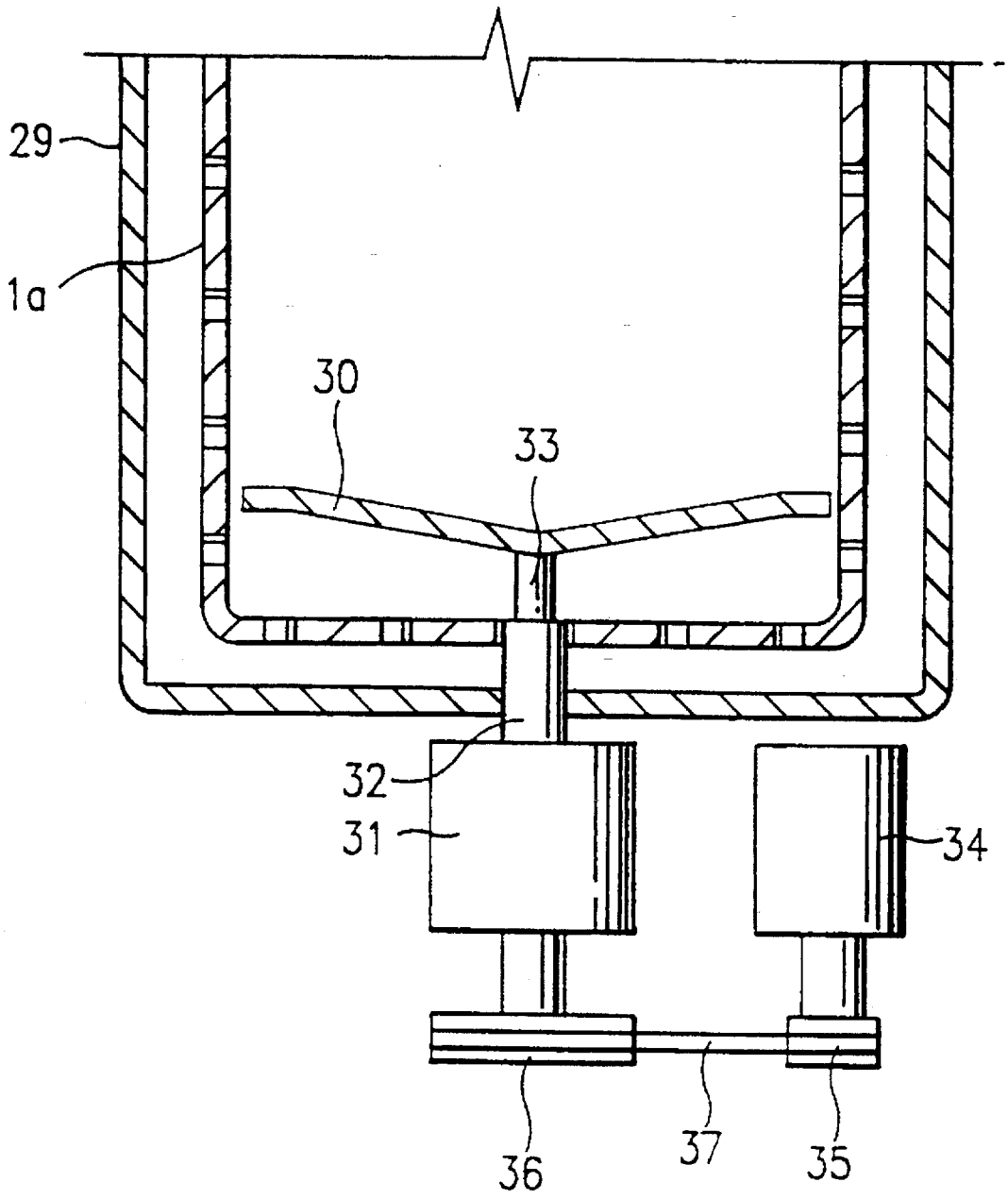
FIG.1 PRIOR ART
FIG. 1 is a vertical section illustrating a conventional fully automatic washing machine.

When V3 is open, air-compressing means 105 transmits the compressed air to bellows 129 inside of washing tub 101. By means of compression of bellows 129 the dehydrated water is drained to outside as V6 opens. Meantime, as shown in FIG. 1, direction converting valve 131 being at a "comp" mode intakes air when piston 104 falls down, and when piston 104 rises, compresses the intaken air and transmits the same to bellows 129.

4. Pressure Reducing Mode

After dehydration is completed, direction converting valve 131 is placed at a "decomp" mode V3 and V4. Then, valves V3 and V4 are opened and the air inside of bellows 129 is exhausted. However, in this state, pressure inside of bellows 129 is lowered only to atmospheric pressure. The volume enlarged for dehydration remains as before. Hence, the volume should be forcibly reduced by lowering pressure in bellows 129 and bellows 129 should be restored to its initial position. Thus, when piston 104 falls, the air in bellows 129 is intaken, and when piston 104 rises, the intaken air is exhausted. At this point, $V_6$ is open to cause piston 104 to rise.

5. Completion Mode

V2, V4 and V5 are opened to dry the inside of washing tub 101.

Hereinafter, another embodiment of the present invention will be described referring to FIGS. 9 and 10.

Figure 9:
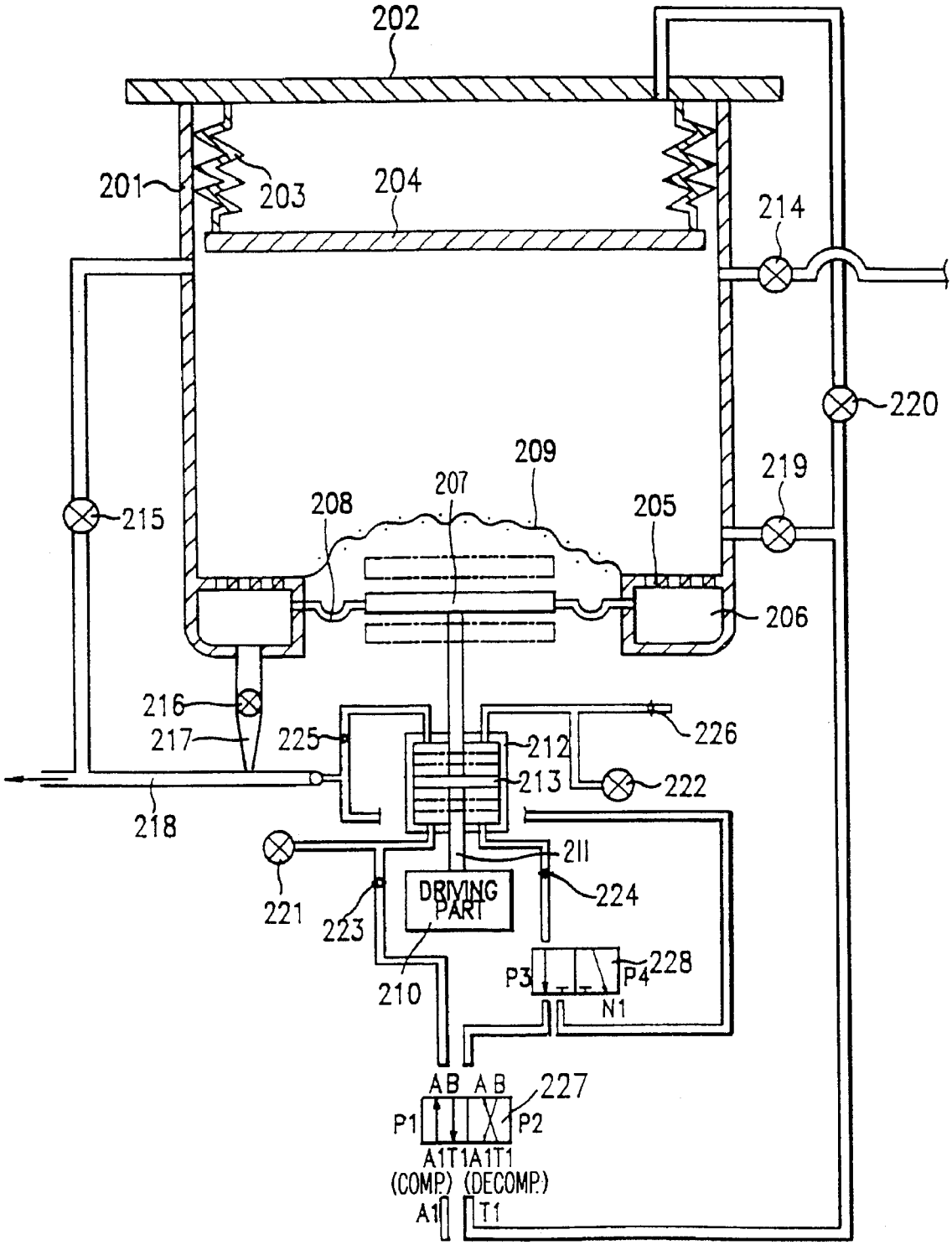
FIG. 9 is a vertical section of a washing machine according to the present invention.

As shown in FIG. 9, another embodiment of the present invention comprises a reciprocation shaft 211, being vertically installed under a washing tub 201, for reciprocating a vibrator 207 to vibrate and wash the laundry, a driving/compressing means 210, being made coaxial to reciprocation shaft 211, for driving electromotive reciprocation shaft 211 up and down, compressing air with up and down strokes of reciprocation shaft 211 and implanting the compressed air into washing tub 201, a pressure-applying dehydration means for applying pressure and dehydrating the laundry in the washing tub by expansion due to the air compressed by means of the driving/dehydrating means 210, and an intaking dehydration means for passing the compressed air through a venturi tube the compressed air and intaking water from the laundry by utilizing the sharp fall of pressure produced in the venturi tube.

The driving/compressing means comprises a cylinder 212 for supporting and guiding reciprocation of electromotive reciprocation shaft 211 driven by external force and a piston 213, being coaxially associated at the circumference of reciprocation shaft 211, for compressing intaken air in upper and lower portions of cylinder 212.

The controlling means consists of a washing step of implanting into the laundry the air compressed in the driving/compressing means, a first dehydration step of transmitting a portion of the compressed air injected into the laundry to the pressure-applying dehydration means and transmitting the remaining compressed air to the intaking dehydration means, after the washing step completes, a second dehydration step of transmitting the air implanted into the pressure-applying dehydration means to the intaking dehydration means when the pressure of the pressure-applying dehydration means reaches a predetermined level, and a restoration step of exhausting the air of the pressure-applying dehydration means when the dehydration step is completed.

A cover 202 for closing washing tub 201 is arranged above washing tub 201 of the low-frequency vibration washing machine containing a many-phases medium consisting of water, detergent and air layer. Under cover 201, a bellows 203 which can elastically contract and expand inside of washing tub 201 is installed. Under bellows 203, a pressing plate 204 for pressing and dehydrating the laundry in washing tub 201 is installed. Bellows 203 and pressing plate 204 are main components of the pressure-applying means.

A reservoir 206 is integrally formed at the inner circumference surface of and lower portion of washing tub 201. Water extracted by the pressure of pressing plate 204 during dehydration flows into reservoir 206 through a plurality of dehydration openings 205.

At the outer circumference of the end tip of vibrator 207, a disc sealer 208 for sealing the lower space and washing tub 201 so as not to drain water or air. Also, at the outer circumference of vibrator 207 and reservoir 206, a dehydration net 9 for preventing the laundry from being damaged by reciprocating vibrator 207.

A water-supplying valve 214 for supplying water into washing tub 201 is associated with the upper portion of washing tub 201. At the other portion of washing tub 201, an exhaustion valve 215 for exhausting the air in the closed washing tub when water is supplied is connected. A draining valve 216 for draining water in washing tub in dehydration is installed at the lower portion of reservoir 206. A venturi tube 217 is connected to a draining pipe 218 along with draining valve 215.

Also, at one portion of washing tub 201, a first air-supplying valve 219 is connected for implanting a small amount of air to the area around vibrator 207 during early washing. At the center of one portion of washing tub 201, a second air-supplying valve 220 for supplying air to bellows 203 is connected.

First and second air-intaking blocking valves 221 and 222 are connected to cylinder 212 for flowing air in and out of cylinder 212 by being selectively opened. First, second, third, and fourth check valves 223, 224, 225, and 226 are connected to cylinder 212 for making fluid flow in one direction for intaking and supplying the fluid according to the reciprocation of piston 213. A port-4 position-2 direction-1 converting valve 227 and a port-3 position-2 direction-2 converting valve 228 are connected to first and second check valves 223 and 224.

The operation of this embodiment having such a structure will be described now referring to FIGS. 9 and 10.

The laundry is input into washing tub 201 through opening cover 202. Then water is supplied in the low-frequency vibration washing machine. When washing tub 201 is closed by closing the cover, the bellows being contracted installed beneath the cover remains in the upper space of washing tub 201. First and second air-inhaling valves 221 and 222, water draining valve 216 and first and second air-supplying valves 219 and 220 are blocked. Water-supplying valve 214 and air-exhausting valve 215 are opened.

When water is supplied through water-supplying valve 214 connected to the water pipe leading into washing tub 201, air in the closed washing tub is exhausted out through air-exhausting valve 215 in the same volume as the volume of water flowing in.

During washing, first and second air-inhaling valves 221 and 222 are opened, however, water draining valve 216, air-exhausting valve 215, water-supplying valve 214 and first and second air-supplying valves 219 and 220 are blocked. Port-4 position-2 direction-1 converting valve 227 connected to first check valve 223 is positioned at "P1," and direction-2 converting valve 228 connected to second check valve 224 is positioned at "P3." Accordingly, when power is transmitted to vibrator 207 through reciprocation shaft 211 according to the driving of a driving portion 210, washing by non-linear resonance is performed in washing tub 201.

Meanwhile, air in cylinder 212 repeats the intaking and exhausting processes according to the up and down movements of piston 213 installed on reciprocation shaft 211.

When piston 213 rises, air as much as the stroke volume of piston 213 is intaken through first air-inhaling blocking valve 221 and first check valve 223 since the lower portion of cylinder 212 bears lower pressure. On the contrary, the air in the upper portion of cylinder 212 becomes contracted by that much, however, since only second air-inhaling blocking valve 222 is open, the air is exhausted through the second air-inhaling blocking valve 222.

When piston 213 falls, air is intaken into cylinder 212 through second air-inhaling blocking valve 222 and third check valve 226 and exhausted through first air-inhaling blocking valve 221. Since direction-2 converting valve 228 connected to second check valve 224 is positioned at "P3," and air sequentially passing through second check valve 224, "B" and "T" are blocked by second air-supplying valve 220, there will be no flow.

Also, after washing is completed, in dehydration step 1, draining valve 216 and second air-supplying valve 220 are open and first and second air-inhaling blocking valves 221 and 222, water-supplying valve 214, and first and second air-supplying valves 219 and 220, are blocked. Direction-1 converting valve 227 is positioned at "P1" and direction-2 converting valve 228 is positioned at "P3."

Accordingly, with the up and down movements of piston 213, the upper and lower portions alternates positive pressure (+) and negative pressure (–). When the lower pressure if (+), bellows 203 is filled with air passed through second check valve 24, route "B" through "T1," and second air-inhaling valve 220. Here, since the upper portion of cylinder 212 becomes (–), outside air is flowed in through third check valve 226. Reversely, when the lower portion of cylinder 212 becomes (–), air is intaken through first check valve 223 into the lower portion of the cylinder. Since when the lower portion is (–), the upper portion is (+), air passes through fourth check valve 225 to draining pipe 218. Here, since draining valve 216 connected to draining pipe 218 is installed at venturi tube 217, the pressure of the venturi tube falls as flow of air through draining pipe 218 becomes faster. Owing to the above pressure fall, water in washing tub 201 is drained through dehydration openings 205 on reservoir 206.

After such processes are repeated for a time, the inside of bellows 203 becomes expanded with high pressure and pressing plate 204 under bellows 203 presses the laundry. Due to continuing venturi effect, air in washing tub 201 is inhaled from draining valve 216, enhancing dehydration efficiency.

Also, in dehydration step 2, i.e., the inner pressure of bellows 203 exceeds a predetermined pressure, as direction-2 converting valve 224 is switched from "P3" to "P4," the inner pressure of bellows 203 stops increasing. Bellows 203 keeps pressing the laundry constantly under the high pressure state. Air which is supplied to the inside of bellows 203 through second check valve, "B" and "T1" passes second check valve 224, "N1," third check valve 225, fourth check valve "226," and draining pipe 218. Accordingly, since the venturi effect of draining pipe 218 becomes much higher than that in dehydration step 1, dehydration efficiency can be maximized.

When the dehydration stroke is completed, first and second air-inhaling blocking valves 221 and 222 are blocked and draining valve 216, air-exhausting valve 215 and second air-supplying valve 220 are open. Direction-1 and -2 converting valves 227 and 228 are positioned at "P2" and "P3," respectively. In this case, air in bellows 203 is exhausted after passing through first check valve 223, second check valve 224, "B," and "A1" by means of direction-1 converting valve 227. Since air-exhausting valve 215 is open, the inside of washing tub 201 continues the atmosphere state. Thus, bellows 203 is contracted to the initial position without any resistance and processes of water-supplying, washing and dehydration becomes completed.

On the other hand, when a small amount of air is intentionally implanted into around vibrator 207 in washing tub 201, input energy and load can be reduced and non-linear resonance phenomenon is easily generated. For this to occur, first, open first and second air-supplying blocking valves 221 and 222, and close draining valve 216, air-exhausting valve 215, water-supplying valve 214 and first and second air-supplying valves 219 and 220. Second, direction-1 and direction-2 converting valves 227 and 228 are positioned at "P1" and "P3." Accordingly, air is injected into washing tub 201 through second air-supplying valve 220 for a short time.

Further, since dehydration net 209 is installed at outer circumference of reservoir 206 on vibrator 207, the laundry disposed between pressing plate 204 and vibrator 207 can be prevented from being damaged by reciprocating vibrator 207 during washing and dehydration.

The merits in the low-frequency vibration washing machine are as follows.

First, the structure of a washing machine is simplified.

Second, washing water can be saved since there is no undesired water between the outer tub and washing tub in a centrifugal dehydration type.

Third, the pressure dehydration method prevents vibration due to rotation of the washing tub during dehydration.

Fourth, the pressure dehydration method also prevents laundry from getting entangled and damaged.

What is claimed is:

1. A driving mechanism of a pressure dehydration low-frequency washing machine comprising:

a washing tub having an oscillating plate;

an electromotive rotation shaft having first and second rotation directions and rotation forces horizontally installed below the washing tub;

selective driving means for driving the oscillating plate on the washing tub by selectively converting the rotation force of said electromotive rotation shaft to a reciprocation force when the rotation direction of said electromotive rotation shaft is in a first direction;

air-compressing means for converting the rotation force of said electromotive rotation shaft to reciprocation force and compressing air by means of a piston driven by the reciprocation force;

pressure-applying dehydration means for applying pressure and dehydrating the laundry in the washing tub by being expanded by compressed air in said air-compressing means when said electromotive rotation shaft is rotated in a second direction where said selective driving means is not driven; and controlling means for selectively transferring the compressed air in said air-compressing means to said-pressure-applying dehydration means.

2. A driving mechanism of a pressure dehydration low-frequency washing machine according to claim 1, wherein said selective driving means comprises:

a hollow shaft where said electromotive rotation shaft is inserted therein;

a cam fixed to the circumference of said hollow shaft;

a connecting rod, being rotatively coupled at the circumference of said cam, for transferring the reciprocation;

a reciprocation shaft for transferring the reciprocation transferred from said connecting rod to said vibrator; and clutching means for selectively coupling said electromotive rotation shaft and said hollow shaft.

3. A driving mechanism of a pressure dehydration low-frequency washing machine according to claim 2, wherein said clutching means is a clutch spring for selectively transferring the power of said electromotive rotation shaft to said hollow shaft according to the rotation direction of said rotation shaft, being coupled at a linking area of said electromotive rotation shaft and said hollow shaft.

4. A driving mechanism of a pressure dehydration low-frequency washing machine according to claim 1, wherein said controlling means is operated following the steps of:

injecting air into the laundry being washed in a washing mode;

injecting air into said compressing means when a dehydration mode begins after the washing mode ends; and extracting the air in said compressing means when the dehydration mode is completed.

5. A driving mechanism of a pressure dehydration low-frequency washing machine for washing laundry comprising:

a washing tub having a vibrator;

an electromotive reciprocation shaft, being vertically installed under the washing tub, for reciprocating the vibrator to vibrate and wash the laundry;

driving/compressing means, being coaxial to said reciprocation shaft, for driving the electromotive reciprocation shaft up and down, compressing air with the up and down strokes of the reciprocation shaft, and injecting the compressed air into the washing tub;

pressure-applying dehydration means for applying pressure and dehydrating the laundry in the washing tub by expansion due to the air compressed by means of said driving/dehydrating means;

intake dehydration means for passing the compressed air through a venturi tube and intaking water from the laundry by utilizing a sharp fall of pressure produced in the venturi tube; and controlling means for selectively transmitting the air compressed by said driving/compressing means to said-pressure-applying dehydration means.

6. A driving mechanism of a pressure dehydration low-frequency washing machine according to claim 5, wherein said driving/compressing means comprises:

a cylinder for supporting and guiding reciprocation of said electromotive reciprocation shaft driven by external force; and a piston, being coaxially associated at the circumference of said reciprocation shaft, for compressing intake air in upper and lower portions of said cylinder.

7. A driving mechanism of a pressure dehydration low-frequency washing machine according to claim 5, wherein said controlling means is operated to:

wash the laundry by injecting into the laundry the air compressed in the driving/compressing means;

dehydrate the laundry by transmitting a portion of the compressed air injected into the laundry to said pressure-applying dehydration means and transmitting the remaining compressed air to said intaking dehydration means, after the washing step is completed;

dehydrate the laundry by transmitting the air injected into said pressure-applying dehydration means and then to said intaking dehydration means when the pressure of said pressure-applying dehydration means reaches to a predetermined level; and restore the washing machine to its initial state by exhausting the air of said pressure-applying dehydration means when said dehydration action is completed.

* * * * *